US007520223B2

(12) United States Patent
Sharpe et al.

(10) Patent No.: US 7,520,223 B2
(45) Date of Patent: Apr. 21, 2009

(54) EXPLOSIVE EFFECT MITIGATED CONTAINERS

(75) Inventors: Kevin John Sharpe, Essex (GB); Jack Waddell, Houston, TX (US); James F. Gordon, Nokomis, FL (US)

(73) Assignee: Blastgard Technologies, Inc., Clearwater, FL (US)

( * ) Notice: Subject to any disclaimer, the term of this patent is extended or adjusted under 35 U.S.C. 154(b) by 0 days.

(21) Appl. No.: 10/834,165

(22) Filed: Apr. 29, 2004

(65) Prior Publication Data

US 2005/0188825 A1 Sep. 1, 2005

Related U.S. Application Data

(63) Continuation-in-part of application No. 10/630,897, filed on Jul. 31, 2003.

(51) Int. Cl.
*F42D 5/05* (2006.01)

(52) U.S. Cl. ..... 102/303; 86/50; 244/121; 89/36.02; 89/36.11

(58) Field of Classification Search ..... 86/50; 102/303; 244/121; 89/36.02, 36.04, 36.07, 89/36.08, 36.11
See application file for complete search history.

(56) References Cited

U.S. PATENT DOCUMENTS

| | | | | |
|---|---|---|---|---|
| 2,602,302 | A | | 7/1952 | Poux et al. |
| 2,733,177 | A | | 1/1956 | Meyer |
| 2,738,297 | A | | 3/1956 | Pfistershammer |
| 2,974,788 | A | | 3/1961 | Robbins |
| 3,331,322 | A | | 7/1967 | Belanger |
| 3,360,014 | A | | 12/1967 | Poisson et al. |
| 3,371,604 | A | | 3/1968 | Per Folke Wikner et al. |
| 3,491,847 | A | * | 1/1970 | Abbott ..... 180/271 |
| 3,736,838 | A | | 6/1973 | Butterweck et al. |
| 3,786,956 | A | * | 1/1974 | Tabor ..... 220/560.01 |
| 3,801,416 | A | | 4/1974 | Gulbierz |
| 4,184,788 | A | | 1/1980 | Colle |
| 4,251,579 | A | | 2/1981 | Lee et al. |
| 4,287,250 | A | | 9/1981 | Rudy |
| 4,299,872 | A | | 11/1981 | Miguel et al. |
| 4,369,885 | A | | 1/1983 | Redmond |
| 4,389,947 | A | * | 6/1983 | King et al. ..... 109/1 S |
| 4,700,706 | A | | 10/1987 | Munch |
| 4,750,318 | A | | 6/1988 | Matsuzawa |

(Continued)

FOREIGN PATENT DOCUMENTS

EP 0276918 A1 8/1988

(Continued)

OTHER PUBLICATIONS

Hawley, G. G., The Condensed Chemical Dictionary, p. 706, Jan. 6, 1974.

(Continued)

*Primary Examiner*—Stephen M Johnson
(74) *Attorney, Agent, or Firm*—Browdy and Neimark, P.L.L.C.

(57) ABSTRACT

A container, such as a standard aircraft unit load device, a truck trailer, a ship's cargo compartment, or the like, is fitted with a blast mitigating material located within the container. The blast mitigating material can be fitted to the container during manufacture, or an existing container can be retrofitted.

8 Claims, 8 Drawing Sheets

U.S. PATENT DOCUMENTS

| | | | | | |
|---|---|---|---|---|---|
| 4,836,079 | A | | 6/1989 | Barrett | |
| 4,864,913 | A | * | 9/1989 | Grunewald et al. | 89/34 |
| 4,966,365 | A | | 10/1990 | Winston | |
| 5,076,168 | A | | 12/1991 | Yoshida et al. | |
| 5,110,661 | A | | 5/1992 | Groves | |
| 5,155,959 | A | | 10/1992 | Richards | |
| 5,196,254 | A | | 3/1993 | Akiyama | |
| 5,225,622 | A | | 7/1993 | Gettle et al. | |
| 5,267,665 | A | * | 12/1993 | Sanai et al. | 220/88.1 |
| 5,287,961 | A | | 2/1994 | Herran | |
| 5,309,690 | A | | 5/1994 | Symons | |
| 5,312,182 | A | | 5/1994 | Mlakar et al. | |
| 5,333,532 | A | | 8/1994 | Smirlock et al. | |
| 5,340,632 | A | | 8/1994 | Chappuis | |
| 5,364,679 | A | * | 11/1994 | Groves | 428/76 |
| 5,366,105 | A | * | 11/1994 | Kerman et al. | 220/62.11 |
| 5,394,786 | A | * | 3/1995 | Gettle et al. | 86/50 |
| 5,413,410 | A | | 5/1995 | Mlakar | |
| 5,534,343 | A | | 7/1996 | Landi et al. | |
| 5,563,364 | A | | 10/1996 | Alhamad | |
| 5,576,511 | A | | 11/1996 | Alhamad | |
| 5,595,431 | A | | 1/1997 | Mlakar | |
| 5,599,082 | A | | 2/1997 | Mlakar et al. | |
| 5,686,689 | A | | 11/1997 | Snedeker et al. | |
| 5,738,925 | A | | 4/1998 | Chput | |
| 5,739,458 | A | | 4/1998 | Girard | |
| 5,830,548 | A | | 11/1998 | Andersen et al. | |
| 5,849,394 | A | | 12/1998 | Bussey, III et al. | |
| 5,868,353 | A | * | 2/1999 | Benard | 244/118.1 |
| 5,996,115 | A | | 12/1999 | Mazelsky | |
| 6,177,368 | B1 | * | 1/2001 | Fisher | 442/221 |
| 6,279,399 | B1 | | 8/2001 | Holm | |
| 6,289,816 | B1 | | 9/2001 | Keenan et al. | |
| 6,397,753 | B2 | * | 6/2002 | Keenan et al. | 102/303 |

FOREIGN PATENT DOCUMENTS

| | | | |
|---|---|---|---|
| EP | 0312399 | A1 | 4/1989 |
| EP | 1229298 | A1 | 8/2002 |
| FR | 2602038 | A1 | 1/1988 |
| FR | 2607241 | A1 | 5/1988 |

OTHER PUBLICATIONS

Brady, G. S., Materials Handbook, pp. 642-644, Jul. 1, 1959.
Webster's Unabridged Dictionary, p. 1442, 1996.
Collins English Dictionary, 2000.
Transcript: MSNBC Interview of Jack Waddell, Nov. 24, 2004.
Ad for BOXAP Explosive Mitigating Litter Bins, no date.
Letter from Police Scientific Development Branch, U.K., to Mr. Zuill, Hexcell UK Limited, Feb. 9, 1994.

* cited by examiner

EXPLOSIVE EFFECT MITIGATED CONTAINERS

CROSS-REFERENCE TO RELATED APPLICATIONS

The present application is a continuation in part of application Ser. No. 10/630,897, filed Jul. 31, 2003, the entire contents of which are incorporated herein by reference.

FIELD OF THE INVENTION

The present application relates to blast-mitigated container assemblies for transport of baggage, energetic material (including ammunition) and other cargo, as well as blast-mitigated container assemblies for use in densely populated areas, including refuse containers, mail boxes, and the like. The present invention also relates to vehicles such as aircraft, trucks, trains, ships, etc. which are fitted with blast mitigating material in sensitive areas, such as near the fuselage or fuel tanks.

BACKGROUND OF THE INVENTION

It is an unfortunate fact that terrorists often attempt to influence the course of political events through the use of violence. One infamous means of implementing these violent actions, such as the 1988 terrorist bombing of a Pan American flight over Lockerbie, Scotland, is by strategically placing bombs where they will cause the greatest devastation and have the greatest political impact. Indeed, bombs almost seem to be a terrorist weapon of choice. As is well known, terrorist targets are typically chosen on the basis of their vulnerability to such attack and are frequently, if not purposefully, selected without regard for human life.

Crowds of people can, therefore, be an attractive terrorist target due to the intense public reaction that mass murder provides. Further, vehicles are attractive targets because they are compact and will almost always contain people when they are being operated. Terrorists also target containers, such as trash containers and mailboxes located in crowded areas. Aircraft effectively combine these attractions for terrorists.

Despite extremely high security procedures and the use of sophisticated explosive detecting equipment, bombs have still occasionally found their way aboard aircraft. Typically, bombs have been hidden in passenger luggage or in parcels that are stored and carried in the cargo compartment of an aircraft. Since there is a limit to the size of bomb that can be relatively easily detected, one security strategy for protecting the aircraft against the internal detonation of an explosive device is to recognize that small explosive devices may not always be detected, and then plan on ways to reduce the damage which can be caused by such a device.

In the airline industry, it is standard practice to compartmentalize the cargo that is to be carried on board the larger aircraft. This is effected by separating the cargo into separate units, and placing these units of cargo into individual containers, which are commonly referred to as unit load devices (ULDs). Because of regulatory requirements, as well as practical considerations, the shape, size and weight of a ULD for each type of aircraft has been standardized. Consequently, in order to design a ULD that will meet the standard requirements of the industry, and still effectively withstand a substantially large blast from an explosion in the cargo hold within the ULD, the limitations of cost, size and mass must be considered.

Typically, ULDs are shaped as boxes that can include appropriately sloped surfaces that conform the ULD to the aircraft's fuselage when the ULD is in place in the aircraft's cargo compartment.

Essentially, the container is made of several panels which are joined together to form the ULD. Additionally, each ULD has a door or an access hatch, which allows it to be opened for placing cargo into the ULD or for removing cargo from the ULD.

ULDs have typically been made of aluminum, which is light in weight but is not explosion proof. As a consequence, there has been tremendous focus in recent years on redesigning containers to be both blast resistant to explosive devices that are below the detectable threshold and are also light in weight. It is desirable that containers for use on ships and trucks are also light in weight and they must be made explosion proof for the same reasons as for airplanes particularly if they are carrying hazardous cargos.

From studies which have been conducted to determine how a standard ULD will react to an internal explosion, it is known that the panels which form the container of the ULD will tend to bulge outwardly from the effect of a blast deep within the baggage. However, if the source of the explosion is close to a panel, the panel will be easily ruptured. Furthermore, it is known that panels are relatively strong in structurally resisting the tensile stresses generated by the forces involved in normally loading baggage and other cargo carried in the intended design manner, but the panels are massively overmatched by a proximate explosive blast. That is, the panels are highly ineffective in resisting rupture from an explosive event. If the container is to survive a high blast loading, panels of significantly increased strength must replace them. Even after considerably increasing the resistance of the panels to blast, stress analysis shows that the highest stress concentrations that result from an explosion within the ULD occur at the points and around the door or hatch which covers the opening into the ULD. This gives rise to the situation where the panels survive but the joints split. One obvious means for providing a hardened ULD is to simply add more material at the points where the highest stress concentrations occur. It is preferable, however, to avoid this additional weight.

One way to strengthen ULDs and other containers to make them more resistant to blasts is to provide a hardened load carrying device for use in transporting cargo on aircraft, trucks, or ships, which hardened load carrying device is able to resist internal blasts without rupturing, particularly by incorporating reinforcing material at the points where an internal explosion generates the highest stress concentrations in the device. Examples of this are shown in Mlakar et al., U.S. Pat. Nos. 5,599,082, and 5,312,182 and Mlakar, U.S. Pat. Nos. 5,595,431 and 5,413,410.

Other experts in explosives and transport-survivability techniques have studied additional ways to make commercial airliners more resistant to terrorist bombs. One result of these studies has been the development and deployment of new generations of explosive detection devices. As a practical matter, however, there remains a threshold bomb size above which detection is relatively easy but below which an increasing fraction of bombs will go undetected. An undetected bomb would likely find its way into luggage, either carried on board (in cabin) by a passenger or stored in an aircraft cargo container.

Ashley, S., in *Mechanical Engineering* 114(6):81086, 1992, describes a number of redesigned aircraft cargo containers. One type of container described by Ashley is designed to suppress shock waves and contain exploding fragments by safely bleeding off or venting high-pressure gases. Another type of container is designed to guide explosive products overboard by channeling blast forces out of and away from the airplane hull. Several of these containers use composite materials that are both strong and light in weight. However, most of these hardened containers are too expensive and heavy for service with the airlines.

Explosive devices produce high velocity fragmentation emanating both from the device casing and from material close to the point of explosion, so-called secondary fragmentation. In addition, explosive devices produce shock waves that can be characterized by having a rise time that is a virtual discontinuity in the physical properties of the material through which it propagates. These shock waves produce the potentially highly damaging phenomenon known as blast. Shock waves travel at a speed related to their amplitude, with higher pressures traveling faster than lower pressures, and the characteristics of the given medium. Once produced, the shock wave propagates outwardly from the source of the explosion, obeying well-understood physical laws. These laws, the conservation of mass, momentum, and energy describe how the shock propagates through a medium and, importantly, how it propagates from medium to medium with the associated changes in velocity and pressure. Shocks propagating spherically away from the source of the explosion will drop in pressure very rapidly. The decay in pressure generated within or close to structures is highly dependant on the geometry surrounding the explosion. Reflective barriers, tunnels, corners, and many other structural features can reduce the rate at which the shock wave decays, and, in some circumstances, locally increase pressure.

SUMMARY OF THE INVENTION

It is an object of the present invention to overcome the aforesaid deficiencies in the prior art.

It is another object of the present invention to provide containers equipped with blast-mitigating material.

It is yet another object of the present invention to provide containers for use on ships, trucks, and aircraft that contain blast-mitigating material.

It is still another object of the present invention to provide liners for trashcans or other such containers in public places that mitigate the effects of an explosive device in the trashcan or other container. These liners combine a shock attenuating, blast mitigant such as, but not limited to, BlastWrap™, integrated into a container made from a strong anti-ballistic such as, but not limited to, KEVLAR®. The face of the liner exposed to the source of the explosion is manufactured from a frangible material such as, but not limited to, a thin fiberglass layer. The purpose of this liner is to breach rapidly in contact with the blast wave and allows the burning detonation products to mix with the BlastWrap™ contents. This concept is nominated the explosion-mitigating cassette.

It is a further object of the present invention to provide containers for storage and transportation of ammunition and other energetic material. The containers have been designed to protect against sympathetic detonation, ballistic impact, and fast and slow cook off.

It is yet another object of the present invention to provide blast mitigation for airplanes, trucks, trains, and the like, where blast mitigation is made part of the airplane, truck, train, or other vehicle.

The present invention provides blast mitigating container assemblies for transportation of baggage and other cargo about aircraft, ships, trains, and trucks, in order to prevent or minimize damage in the event of an on board explosion, as well as blast mitigating fuselages, holds, cars, and trailers for airplanes, ships, trains, and trucks, and containers for trash cans, mailboxes, and the like.

The container assembly of the present invention comprises a container such as, but not limited to, a standard aircraft unit load device, fitted with a blast mitigating material on the interior of the container. Unit load devices fight tightly inside an aircraft's hold, making it prohibitively expensive and impractical to provide shielding for the outside of the container. The present invention uses blast-mitigating material within the ULD or other container to substantially eliminate the effects of an explosive device from positions within the ULD or other container that come into close proximity to the vulnerable aircraft fuselage. The blast mitigating material can be fitted to the container when the container is manufactured, fitted into the hold during aircraft manufacture, or an existing container can be retrofitted. In the same fashion, trucks trains, and ships can be provided with blast mitigating material in the cargo carrying area of these vehicles.

One blast mitigating material which can be used in the present invention, which is described in more detail in parent application Ser. No. 10/630,897, filed Jul. 31, 2003, is ideally suited to retrofitting unit load devices, ship or truck containers, freight cars on trains, etc., because it is flexible and can be cut to fit exactly where needed. This material, which bears the trademark BlastWrap, is made of two flexible sheets arranged one over the other and joined by a plurality of seams. The seams may be welded, stitched, hot melted together, or joined in any conventional way. The seams are arranged so as to form cells or recesses in the sheets, and the cells are recesses that are filled with a shock attenuating material, such as perlite. The assembly can be cut to the desired size along any of the seams without loss of the shock attenuating material. More importantly, because the assembly is made of flexible sheets, it can be adapted to fit snugly within a container or space, regardless of the shape of the container or space.

Preferably, the blast mitigating material is deployed in containers in areas in which the aircraft is particularly vulnerable to explosive blast, including but not restricted to, the sloping face of the unit load device. This optimized application of blast mitigating materials is highly desirable in aircraft wherein weight is a significant factor. Some have argued that baggage per se is a good blast mitigant and the threat to an aircraft from explosively driven catastrophic failure occurs when an explosive charge comes close to the aircraft fuselage, as was the case in the Lockerbie disaster. However, the blast mitigating material of the present invention reduces the threat to the aircraft by increasing the separation between the explosive material and the fuselage and by significantly reducing the blast effects of the explosion by mitigation, massively reducing the pressure and impulse loading experienced by the airframe.

Containers protected according to the present invention can be used for storage, transportation, and packaging for cargo or for energetic material such as ammunition. Including blast mitigation, thermal insulation, and fragment slowing or stopping material into a packaging container, either in a large container for a plurality of packages, or for each individual package, the material will prevent sympathetic detonation and protect against fast and slow cook off. This type of container protection also offers a degree of protection against a range of ballistic threats.

Sympathetic detonation results when one detonating unit or energetic material initiates the next, and so on, in a chain like reaction. Sympathetic detonation is the product of an internal high-pressure event being initiated in a store or material. This high-pressure event can be caused by the impinging of a shock wave or by the impact of a primary or secondary fragment from detonating adjacent munitions. Using the packaging according to the present invention will prevent initiation of a single unit so that one unit will not set off a chain-like reaction among the other units packaged therewith.

Fast cook off concerns the initiation of a unit of ammunition or other energetic store in the event of a flash fire such as a fuel fire. Packaging munitions or other such explosives according to the present invention will prevent the ammunition or other energetic material from reaching an auto-ignition temperature.

Slow cook-off refers to the initiation of a unit of ammunition or other energetic material in the event of a slower but more sustained thermal event. The insulating material of the present invention is a good thermal insulator, so packaging munitions or other energetic material according to the present invention will prevent the ammunition or other energetic material from reaching an auto-ignition temperature.

Ballistic impact refers to the initiation a unit of ammunition or other energetic material in the event of an impact by a ballistic threat such as a bullet or other high velocity projectile. Packaging munitions or other energetic material according to the present invention prevents the ammunition or other energetic material from reacting in an energetic fashion.

The storage and transportation packaging designs of the present invention address the above issues by skillful use of suitable shock attenuating material which separates the energetic material from closely located energetic material, or by wrapping the shock attenuating material around energetic material. The shock mitigating material that is preferably used in the present invention is flexible so that it can be wrapped around or inside virtually any shape, and the shock mitigating material can be easily cut to any desired size. The shock mitigating material can be enhanced by incorporating noble or ballistic material, or fibers such as DYNEEMA® or KEVLAR® in the packaging to slow or capture casing fragments, bullets, or other ballistic threats. The use of flash suppressants and intumescent materials for protection against fast and slow cook off is also central to the packaging of the present invention.

The packaging of the present invention can be used for any container that is used for transportation of any substance or material, whether energetic or otherwise. Specifically, the packaging of the present invention can be used in any situation in which the contents of the container are to be protected from a stimulus or event from outside the container, or any scenario where an event inside of the container must be contained and mitigated to protect structures or people, or other vulnerable articles outside of the container.

Another approach to mitigating the effects of blasts is by way of an explosion-mitigating cassette. The cassette comprises an outer shell of anti-ballistic material such as KEVLAR®, an inner filling of a blast mitigating material such as BlastWrap™, and a frangible inner face made from material such as glass fibers. The explosion-mitigating cassette combines these materials in close proximity to each other so that they can effectively deal with the threats of shock, blast, fragmentation, secondary fragmentation, flash and fireball. This arrangement is particularly useful in cases in which mass and volume are limited.

The packaging of the present invention can contain, in addition to blast mitigating material, thermal insulation, intumescent barriers, and fragment slowing or stopping material to mitigate the effects of blast, ballistic, thermal or fragmentation effects from internal or external hazards.

DETAILED DESCRIPTION OF THE INVENTION

Figure 1:
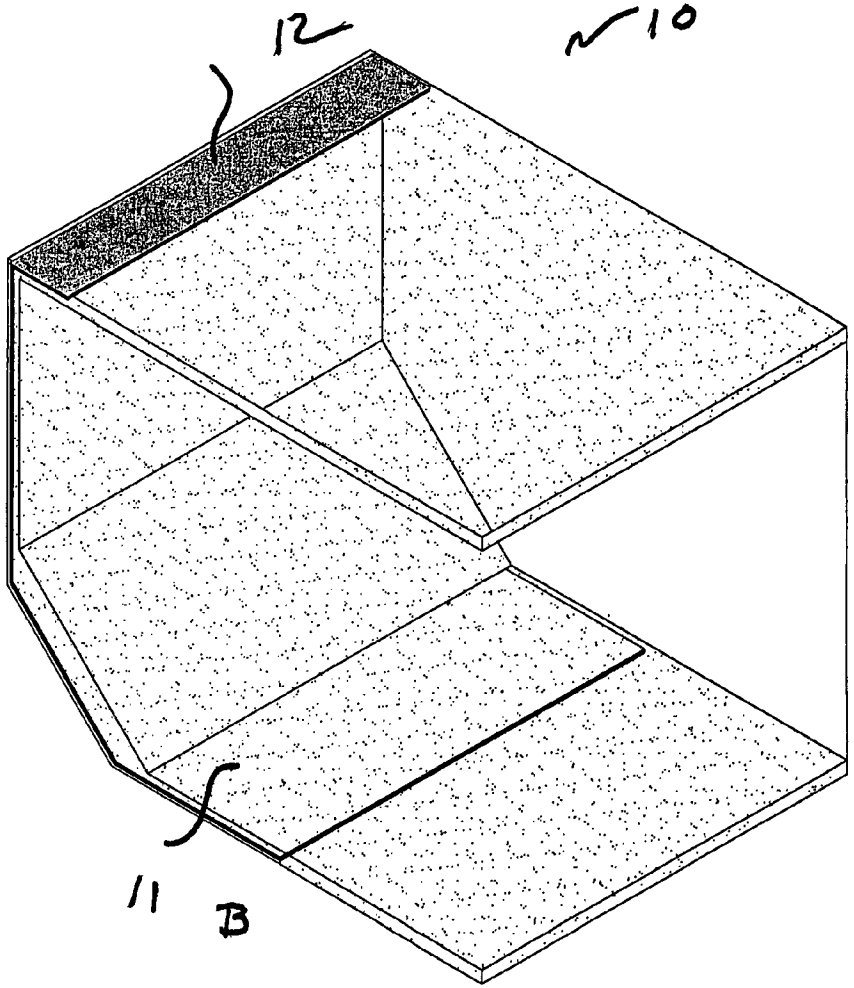
FIG. 1A is a side view of a unit load device container fitted with shock attenuating medium and ballistic material.
FIG. 1B is an open view of a unit load device container fitted with shock attenuating medium and ballistic material.
Figure 1:
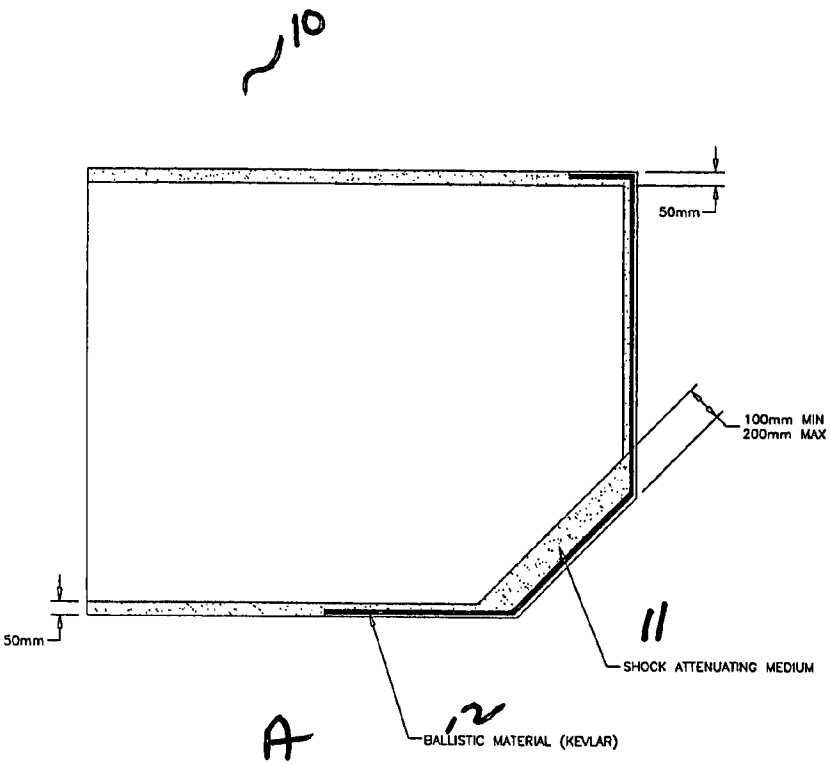

FIGS. 1A and 1B show a ULD 10 which is designed to fit into an aircraft fuselage. The ULD 10 is lined on the interior thereof with shock attenuating material 11. At least part of the outside of the ULD is covered with a ballistic material 12 such as KEVLAR®. To prevent a blast from damaging the fuselage, or damaging other vital areas of the airplane, and to contain the blast within the ULD, blast-mitigating material is placed in positions within the container to protect the vulnerable areas of the aircraft structure.

It has been experimentally demonstrated that aircraft fuselages are vulnerable to explosive impulse. Impulse is defined as the area under the pressure-time history of the blast wave. The relationship between the level of impulse required to initiate the onset of catastrophic failure of the fuselage is related to the applied impulse, the ultimate tensile strength of the fuselage material, and the fuselage thickness. With sufficient knowledge and expertise aircraft vulnerability to explosive device size and explosive device position can be calculated. Calculation and experiment show that small explosive devices that may be difficult to detect are only likely to cause catastrophic failure of the airframe in a limited number of positions.

According to the present invention, the blast-mitigating materials are applied in such positions as to remove threat to the aircraft from explosive devices.

Figure 2:
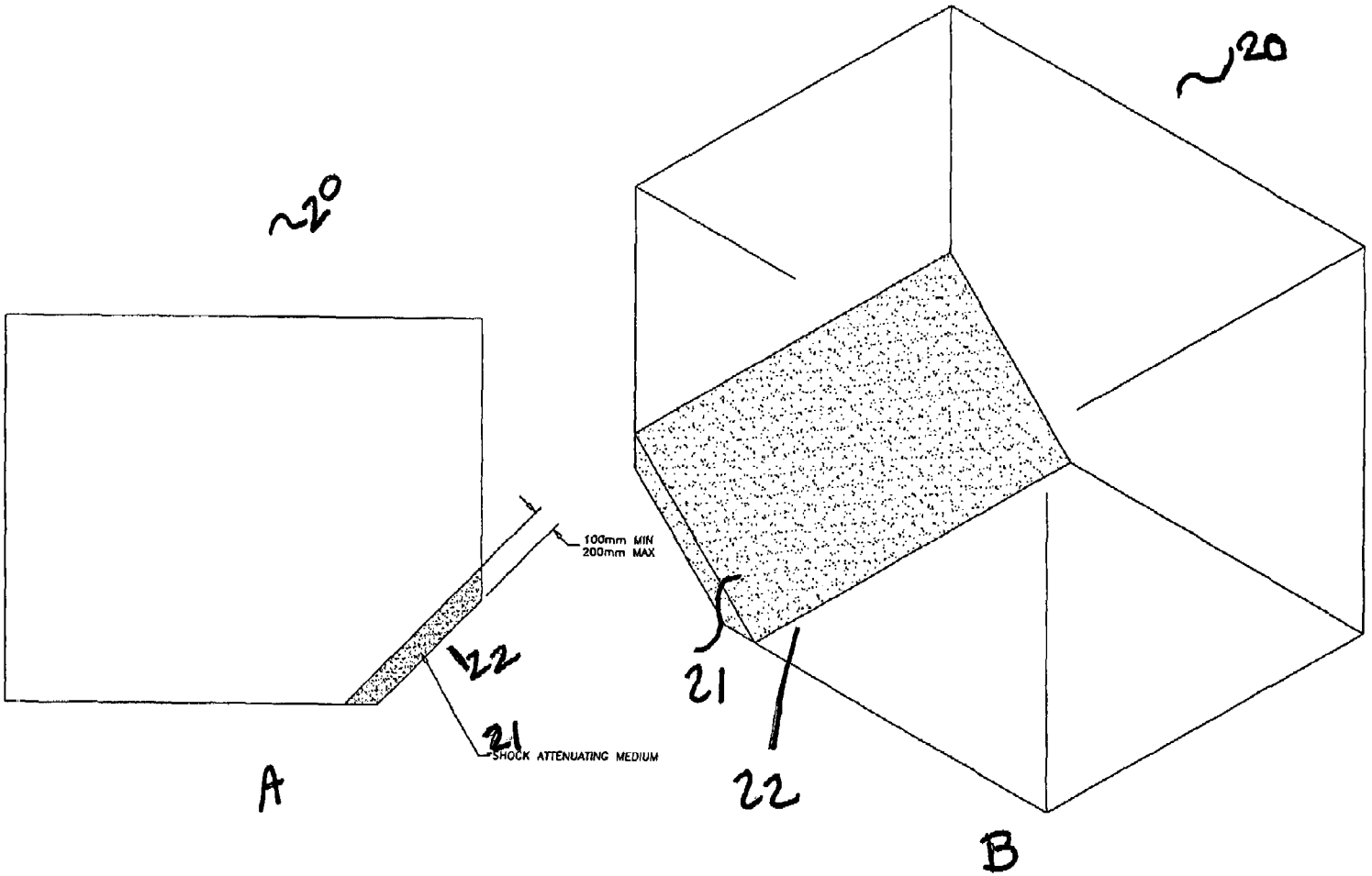
FIG. 2A is a side view of a unit load device container fitted with shock attenuating medium.
FIG. 2B is an open view of a unit load device container fitted with shock attenuating medium.

The simplest and probably most common variant of the blast-mitigated unit load device 20 is shown in FIGS. 2A and 2B. This device 20 has a single panel of blast-mitigating material 21, such as but not limited to BlastWrap™, fitted to the inside of the sloping panel 22 of the ULD. The panel is approximately 100 mm thick, weighting less than nine pounds and taking up less than 5% of the volume of the container. As the material used for blast mitigation is very light in weight, there is little excess weight placed aboard the aircraft.

Figure 3:
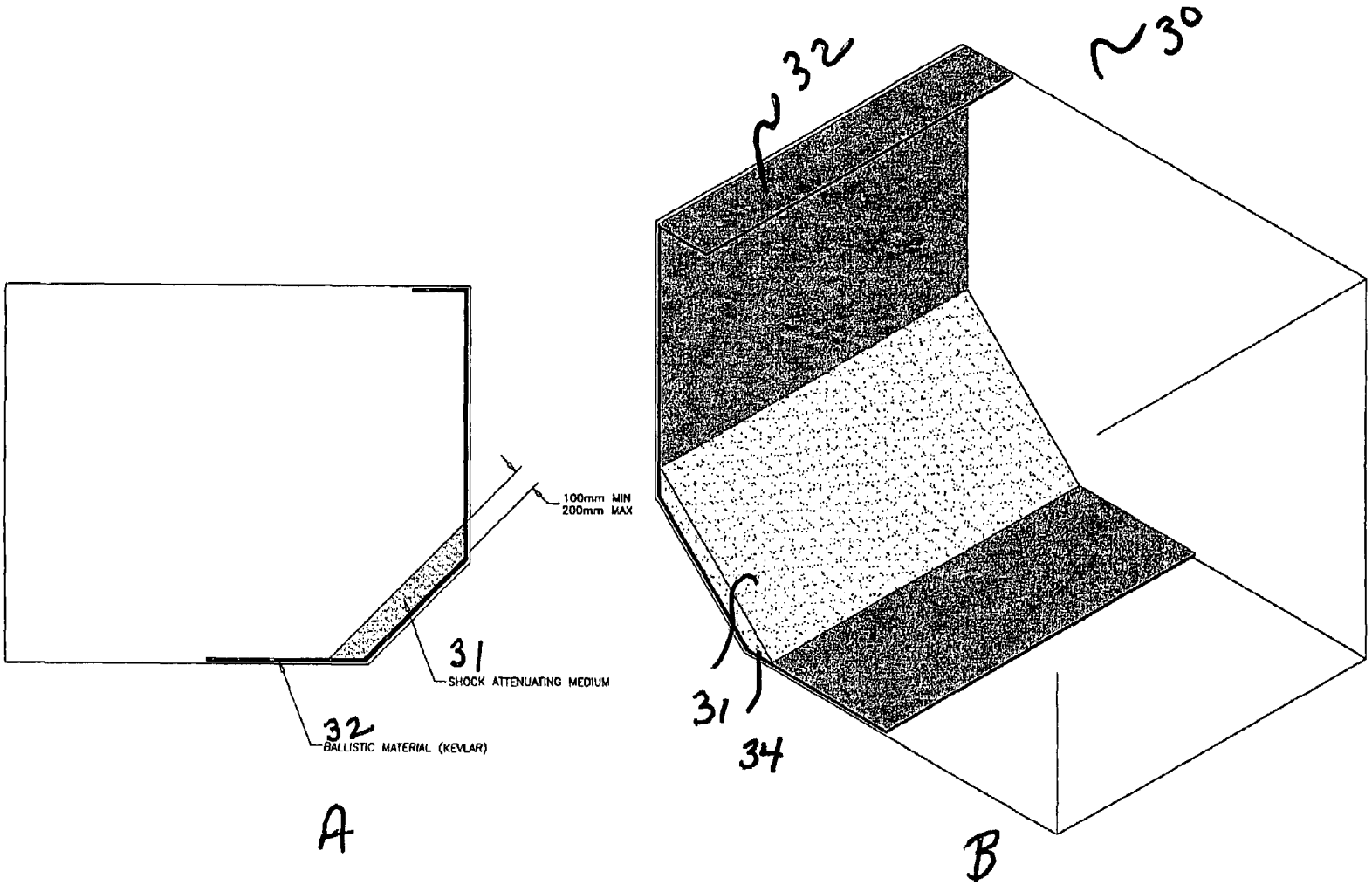
FIG. 3A is a side view of a unit load device container fitted with shock attenuating medium and ballistic material.
FIG. 3B is an open view of a unit load device container fitted with shock attenuating medium and ballistic material.

FIGS. 3A and 3B illustrate another configuration for protecting a ULD 30. The ULD 30 has a single panel of blast-mitigating material 31 fitted to the inside of the sloping panel 34 of the ULD. The outside of at least part of the ULD is equipped with a ballistic material such as KEVLAR®.

While it is known that if an explosive charge is surrounded with any type of dense material (hereby taken for the purposes of this application to relate to materials having a density of 1 gram/cc or more), there is a reduction of blast over pressure generated by an explosive source. This is due to the energy of the explosion being partitioned between the blast wave in air and the shocks propagating in the dense material surrounding the explosive charge. The disadvantage of using dense materials for blast mitigation is that the energy and momentum is conserved and the material is moved away from the site of the explosion at considerable velocity, thus doing damage at a distance remote from the origin of the blast. This has the effect of increasing the damage potential of the explosion. Reduction in blast over pressure is only part of the problem of explosion mitigation. The materials used in the present invention have been chosen for their properties that offer excellent blast pressure reduction properties while conserving little of the explosive energy as momentum. This is achieved by harnessing irreversible processes within the material.

In addition, if a small bomb in carry-on luggage is not detected by airport screening devices, explosive devices may find their way into the overhead bins situated in the passenger cabin. The aircraft, passengers and crew can be protected from the effects of an explosion in an overhead bin by lining the bin with blast mitigating material and ballistic fibers, incorporated into the construction of the overhead bins in a similar fashion as with unit load devices. It is worth noting that the overhead bins are particularly vulnerable areas because an explosive device can be placed close to the aircraft fuselage. Of course, the vulnerable locations are not confined to the baggage hold and the overhead bins, but can be found throughout the aircraft cabin.

As a minimum in protecting an aircraft, blast-mitigating material should be placed at the rear face of the overhead locker, behind the panels in the lavatories that are adjacent to the aircraft fuselage where a potential bomber may be in privacy to assemble and place a device. These areas can be equipped with blast mitigating material and ballistic material in a fashion similar to that for the ULD. The area above the central fuel tank may also be vulnerable to blast, and the present invention can adequately protect this area from explosive attack. Using the blast mitigating material according to the present invention would protect against an attack similar to the one attempted by Richard Reid in his attempt to destroy a transatlantic flight with homemade shoe bombs.

Figure 4:
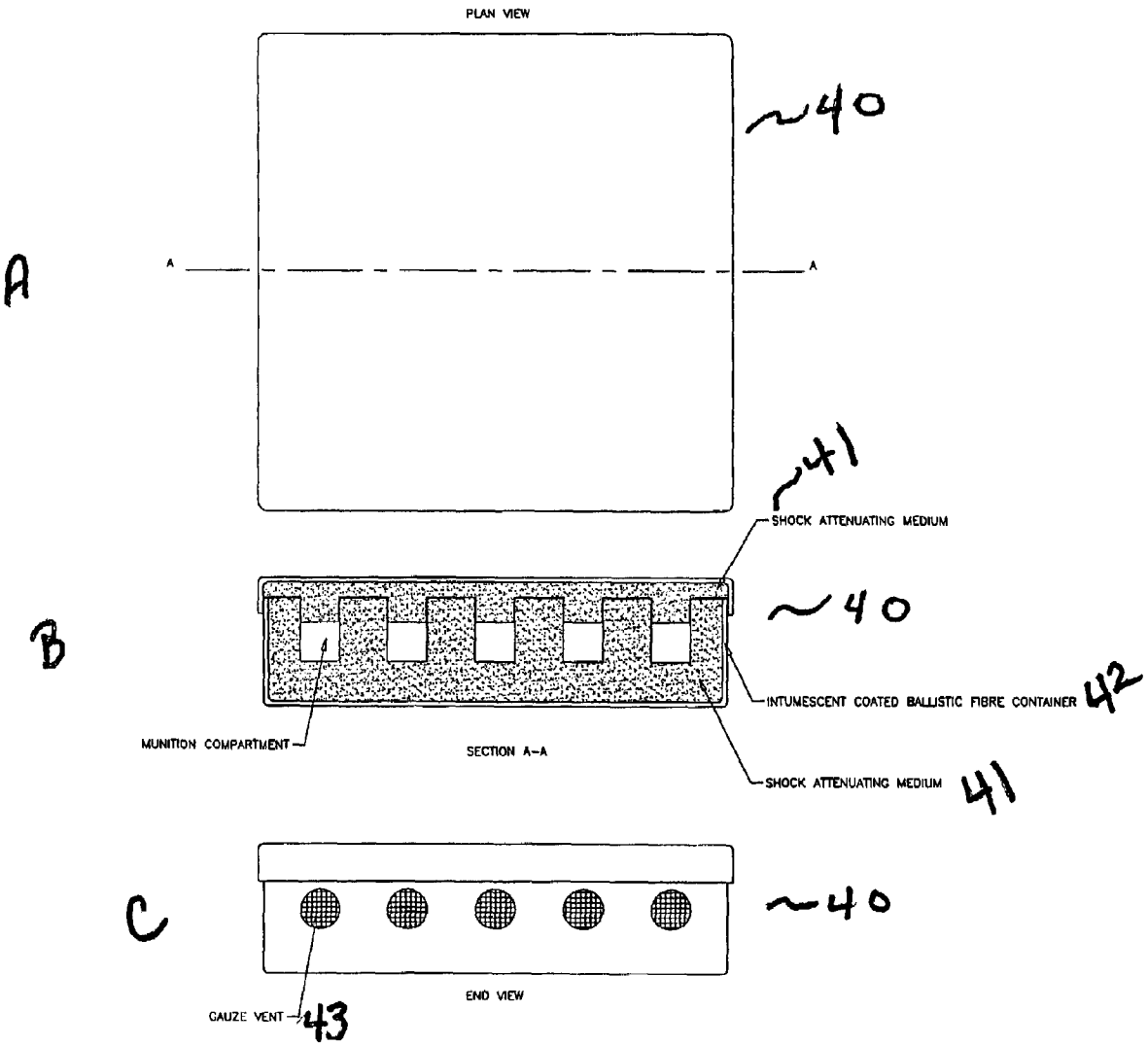
FIG. 4A is a plan view of a pyrotechnic transportation and storage unit.
FIG. 4B is view along section A-A of FIG. 4A of the pyrotechnic transportation and storage unit.
FIG. 4C is an end view of the pyrotechnic transportation and storage unit.

FIGS. 4A, 4B and 4C show a pyrotechnic transportation and storage unit 40 for explosive devices. The inside of the container is lined with shock attenuating material 41, and the container itself is made of or coated with intumescent material. In one example, the container 40 is made of intumescent-coated ballistic fibers. FIG. 4C shows an end view of the container/storage unit 40. Optional fire-extinguishing, gauze vents are provided on at least one face of the container to exhaust any potentially explosive gases that may build up during transportation and/or storage.

Figure 5:
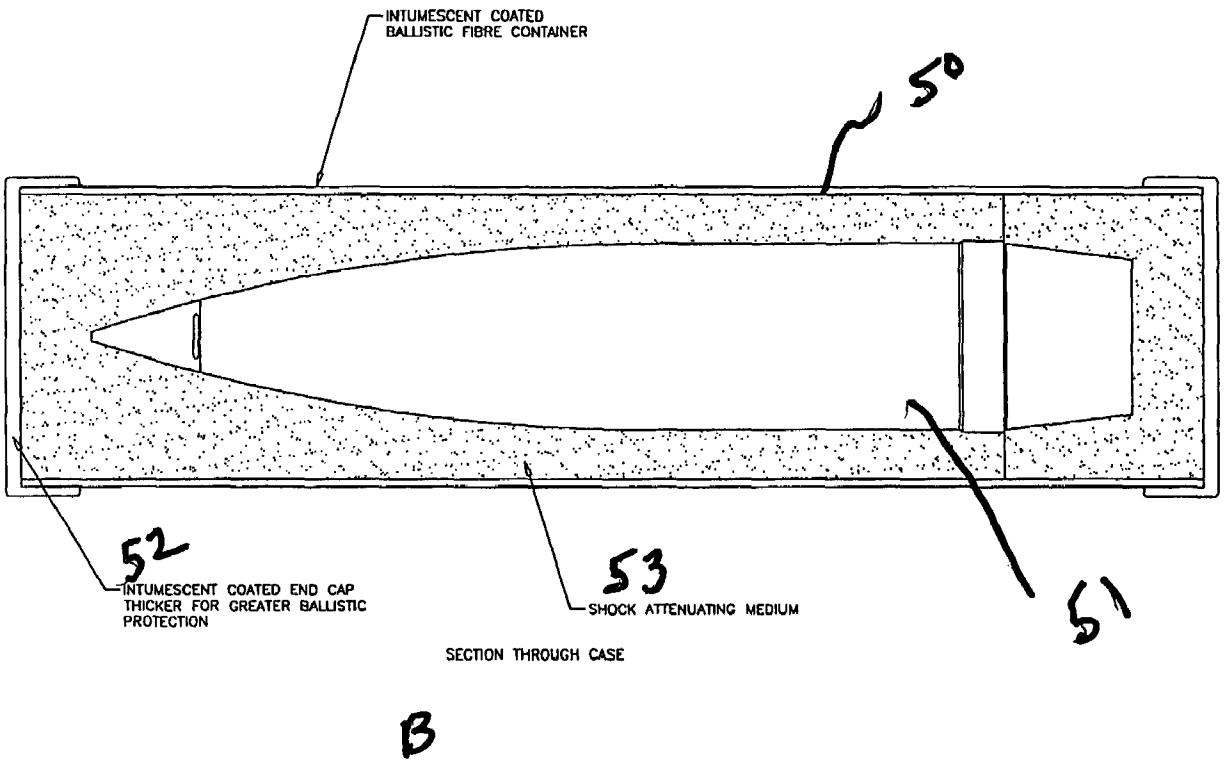
FIG. 5A is an end view of a container for transporting and storing an artillery shell.
FIG. 5B is a cutaway view of a container for transporting and storing an artillery shell.
Figure 5:
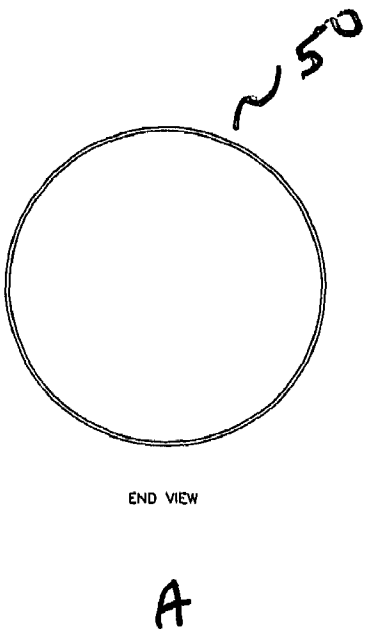

FIGS. 5A and 5B show a transportation and storage container 50 for an artillery shell 51. FIG. 5B shows the container 50, which is made of or coated with an intumescent material, and filled with a shock attenuating medium 53. The end cap 52 of the container is preferably thicker than the walls of the container for greater ballistic protection.

Figure 6:
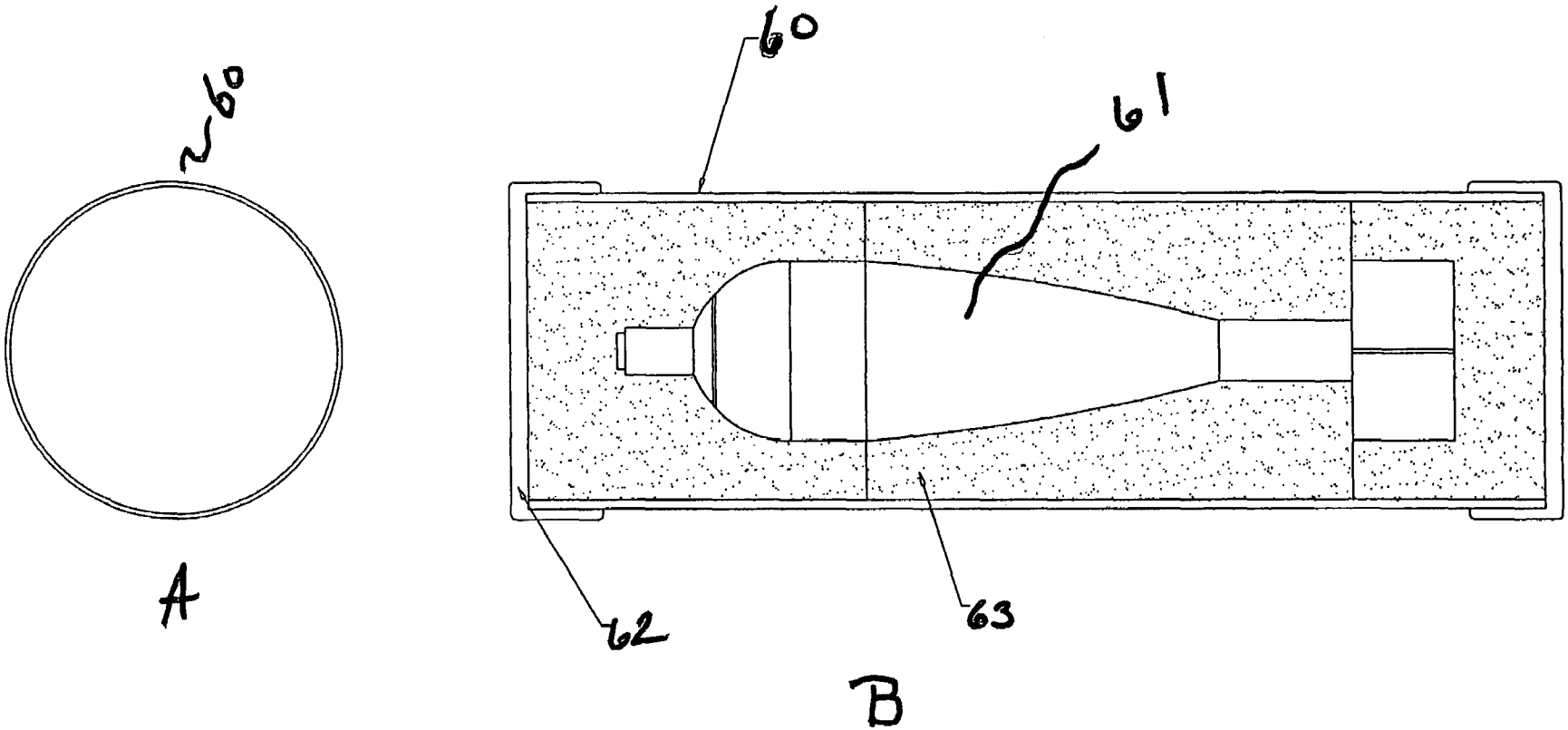
FIG. 6A is an end view of a container for transporting and storage of a mortar.
FIG. 6B is a cutaway view of a container for transporting and storing a mortar.

FIGS. 6A and 6B show a transportation and storage container 60 for a mortar 61. FIG. 6A shows the end of container 60. FIG. 6B shows the container 60, which is made of or coated with an intumescent material, and filled with a shock attenuating medium 63. The end cap 62 of the container is preferably thicker than the walls of the container for greater ballistic protection.

Figure 7:
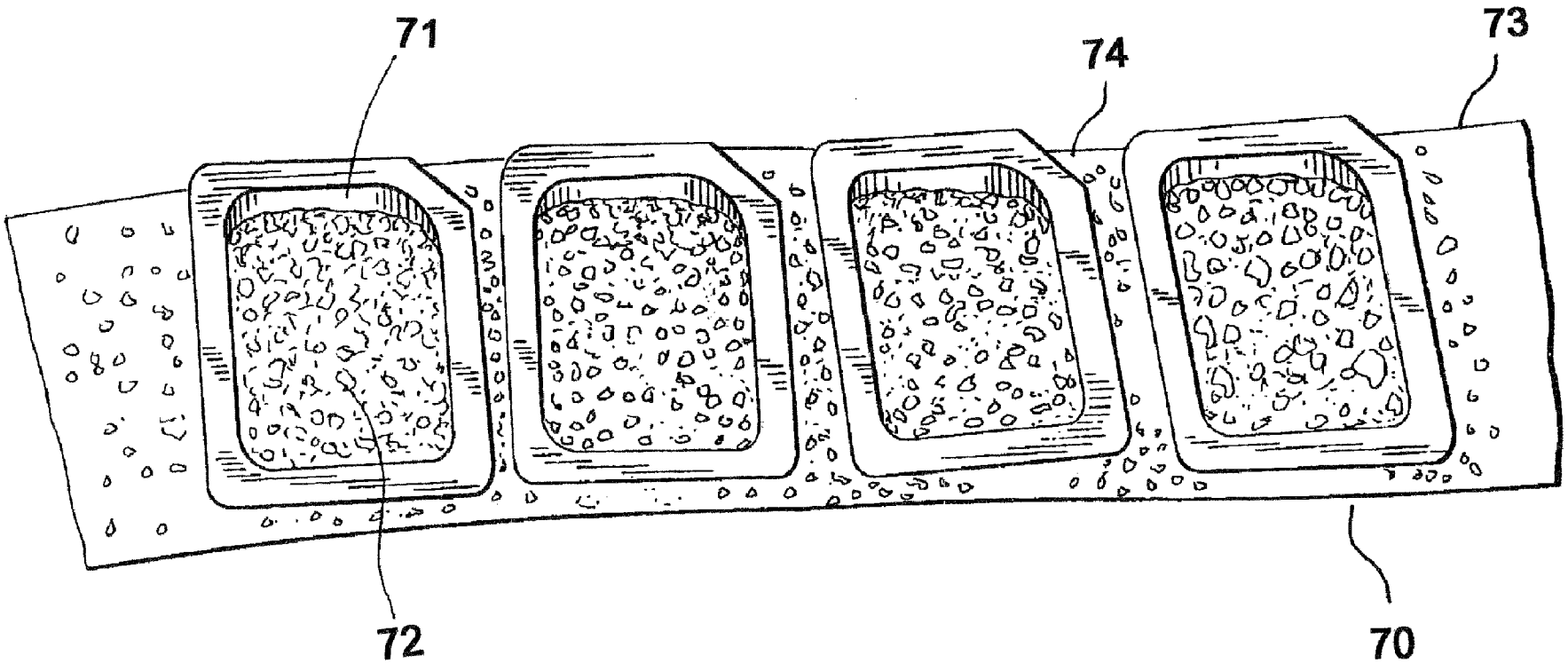
FIG. 7 is a top view of the flexible assembly used to line aircraft.

FIG. 7 shows a top view of the assembly 70 used to line aircraft to provide blast protection. This assembly 70 includes flexible sheets, seams, 74, cells or recesses, 71 and perlite 72.

Figure 8:
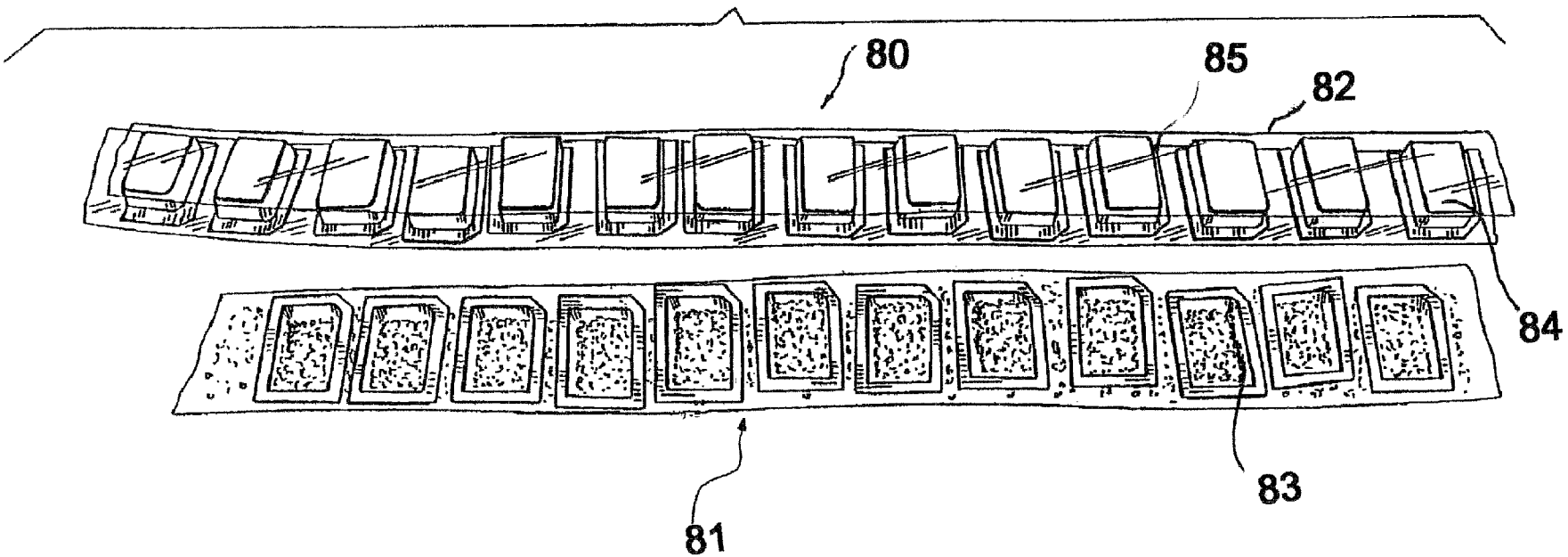
FIG. 8 is another top view of the flexible assembly used to line aircraft.

FIG. 8 is another view of the assembly 80 used to line aircraft for blast protection. Two flexible sheets, 81 and 82, are bonded together at seams 85 to form recesses 84 that hold perlite 83.

The materials used in the present invention are preferably lightweight materials that also possess excellent thermal insulation and fire suppression properties that have other applications on board aircraft and in other types of containers. These materials can be deployed behind the cabin fascia to act as thermal insulation in place of the current fiberglass cladding.

Any type of lightweight, thermally insulating blast mitigating material can be used to protect ULDs, overhead bins, trash cans, trains, trucks, ships, and the like. The preferred material for blast mitigation is the assembly described in Waddell et al., U.S. Ser. No. 10/630,897, filed Jul. 31, 2003, the entire contents of which are hereby incorporated by reference. Blastgard International markets the flexible blast mitigation material described therein as BlastWrap™. This assembly is particularly useful because it is flexible and can be made to conform to the contours of any container, etc., that is to be protected.

In addition to the blast attenuation material in a container, the container may be lined with insulation to protect a system from fire or some types of radiation, including alpha, beta and gamma rays. Intumescent organo polymer coatings can be added to provide additional thermal energy resistance from proximate explosions or post-blast fires, to include chemical fire-suppressing powder or gaseous agents within. These additional materials are well known in the area of insulating and fireproofing, and one skilled in the art can select those materials for the purposes that are suitable for use in aircraft or other cargo holding arrangements or other containers.

The following is a list of examples of blast mitigating material that can be incorporated between flexible sheets to form blast-mitigating assemblies for use in the present invention. This list is by way of illustration only, and is not intended to be an exhaustive list. One skilled in the art can, without undue experimentation, add many other suitable materials to this list.

Perlite

Vermiculite

Pumice in all forms

Aqueous foams

Aerogels

Syntactic foam

Expanded concrete, cinder block, Celcon or other porous building material or block Any porous, crushable material which rapidly reduces shock pressures with distance Any material that exhibits shock attenuation and thus blast-mitigation properties by virtue of two-phase flow.

A number of different types of materials can be used with shock or blast attenuating materials to enhance their effectiveness, particularly with respect to stopping fragments. A list of such materials is as follows:

Fragment Stopping Materials
Foamed aluminum
Foamed steel
Foamed titanium
Aluminum armor plate
Steel armor plate
Aramide fiber such as KEVLAR® or TWARON®
Polyethylene finer such as DYNEEMA® or SPECTRA®
Polybenzobisoxazoles such as ZYLON, a high-performance fiber developed by TOYOBO comprising rigid-rod chain molecules of poly (P-pheynylene-2,6 bezobisoxazole)
G-LAM TM nano-fiber
Ballistic nylon
Extremely hard materials such as ceramic and boron carbide
Glass fiber
Pyrok and other dense, cement based fiber boards Flash and Fire Suppressants
Chlorinated compounds
Brominated compounds
Phosphorous containing compounds
Metal hydroxides
Alkali metal compounds including but not limited to sodium bicarbonate, potassium bicarbonate, sodium carbonate and potassium bicarbonate.
Iron pentacarbonyl
Melamine based materials
Borates such as zinc borate
Low melting point glasses
Materials that generate smothering gaseous products such as bicarbonates, carbonates, and sodium tetrachlorate Fire and Thermal Barriers
Borates such as borax and zinc borate
Silicon based additives
Inorganic alumino-silicate resins
Nano-composites
Expandable graphite
Melamine based materials
Ammonium polycarbonates
Polyurethane foam
Phosphorus containing compounds
Intumescent paints, intumescent coated fabrics, and other intumescent barriers
Endothermic mats and wraps
Silicone RTV foams
Fireproof resins and polymers Any type of container can be enhanced with blast mitigation material according to the present invention to provide protection from blasts. The blast mitigation materials can be such that the container is protected from all types of pressure waves, both acoustic and shock waves, in all gaseous environments, particularly in ambient atmospheric conditions. The blast-mitigated containers protect the aircraft from explosions internally within the container.

By providing containers with blast mitigating materials, noise and shock waves are also attenuated, and projectiles flying from the blast are slowed and in some cases, contained.

For purposes of the present invention, the term "container" is intended to include any type of container for liquids, solids, or gases, including but not limited to unit load devices and overhead bins on aircraft, containers for use on ships, trains and trucks, trash containers, mailboxes and the like, as well as train cars, ship's holds, truck trailers, aircraft, and other vehicles.

The foregoing description of the specific embodiments of the present invention will so fully reveal the general nature of the invention that others can, by applying current knowledge, readily modify and/or adapt for various applications such specific embodiments without undue experimentation and without departing from the generic concept. Therefore, such adaptations and modifications should and are intended to be comprehended within the meaning and range of equivalents of the disclosed embodiments.

It is to be understood that the phraseology or terminology employed herein is for the purpose of description and not of limitation. The means and materials for carrying out disclosed functions may take a variety of alternative forms without departing form the invention. Thus, the expressions "means to . . . " and "means for . . . " as may be found the specification above, and/or in the claims below, followed by a functional statement, are intended to define and cover whatever structural, physical, chemical, or electrical element or structures which may now or in the future exist for carrying out the recited function, whether or not precisely equivalent to the embodiment or embodiments disclosed in the specification above, and it is intended that such expressions be given their broadest interpretation.

What is claimed is:

1. A method for protecting an aircraft from the effects of a blast comprising at least partially lining unit load devices and other containers within the aircraft with a blast mitigation material;

wherein said blast mitigation material is in the form of an assembly of two flexible sheets arranged one over the other and joined by a plurality of seams, the seams being arranged so as to form cells or recesses in the space between the sheets, and wherein the cells or recesses are filled solely with perlite, wherein the perlite is free-flowing within the cells.

2. The method according to clam 1 wherein the other containers are overhead bins in aircraft.

3. The method according to claim 1 wherein the unit load device and other containers are further at least partially lined with a frangible material.

4. The method according to claim 3 wherein the frangible material is fiberglass.

5. The method according to claim 1 wherein the unit load devices and other containers are at least partially lined with at least one additional material selected from the group consisting of thermal insulation, fragment slowing or stopping material, intumescent materials, and materials impervious to alpha, beta or gamma rays.

6. The method according to claim 1 wherein the other containers include behind panels in lavatories adjacent the fuselage.

7. The method according to claim 1 wherein the other containers include an area above the aircraft's central fuel tank.

8. The method according to claim 1 wherein a single panel of the blast-mitigating material weights less than nine pounds.

* * * * *